United States Patent [19]

Tysoe

[11] Patent Number: 4,558,401

[45] Date of Patent: Dec. 10, 1985

[54] VEHICLE LAMP ASSEMBLY

[75] Inventor: Nicholas W. Tysoe, St. John's, England

[73] Assignee: Britax Vega Limited, Worchestershire, England

[21] Appl. No.: 658,063

[22] Filed: Oct. 5, 1984

Related U.S. Application Data

[63] Continuation of Ser. No. 408,206, Aug. 16, 1982, abandoned.

[30] Foreign Application Priority Data

Aug. 29, 1981 [GB] United Kingdom ..... 8126421

[51] Int. Cl.[4] ..... F21V 13/00

[52] U.S. Cl. ..... 362/290; 362/293; 362/309

[58] Field of Search ..... 362/293, 61, 290, 354, 362/309, 308

[56] References Cited

U.S. PATENT DOCUMENTS

| | | | |
|---|---|---|---|
| 1,928,539 | 9/1933 | Labastrou | 362/61 |
| 2,907,249 | 10/1959 | Hjermstad | 240/815.32 |
| 3,487,206 | 12/1969 | Dawson et al. | 362/80 |
| 3,522,424 | 8/1970 | Fritsch | 362/268 |
| 3,544,786 | 12/1970 | Baker | 362/64 |
| 4,241,388 | 12/1980 | Green | 362/268 |
| 4,305,116 | 12/1981 | Huber | 362/354 |
| 4,383,290 | 5/1983 | Binder | 362/293 |

FOREIGN PATENT DOCUMENTS

| | | | |
|---|---|---|---|
| 2748947 | 5/1979 | Fed. Rep. of Germany | 362/290 |
| 689008 | 4/1965 | Italy | 362/354 |
| 565548 | 11/1944 | United Kingdom | 362/354 |

*Primary Examiner*—Andrew M. Dolinar
*Attorney, Agent, or Firm*—Young & Thompson

[57] ABSTRACT

A vehicle lamp assembly, of the type in which the color of the light to be produced by the lamp cannot readily be perceived when the lamp is not illuminated, comprises an outer light transmitting member having horizontal strips of opaque material embedded in its outer surface. A respective horizontal baffle is aligned with each opaque strip. A lens element focuses collimated light on the gaps between the strips and can also serve as a color filter.

4 Claims, 5 Drawing Figures

Figure 5:
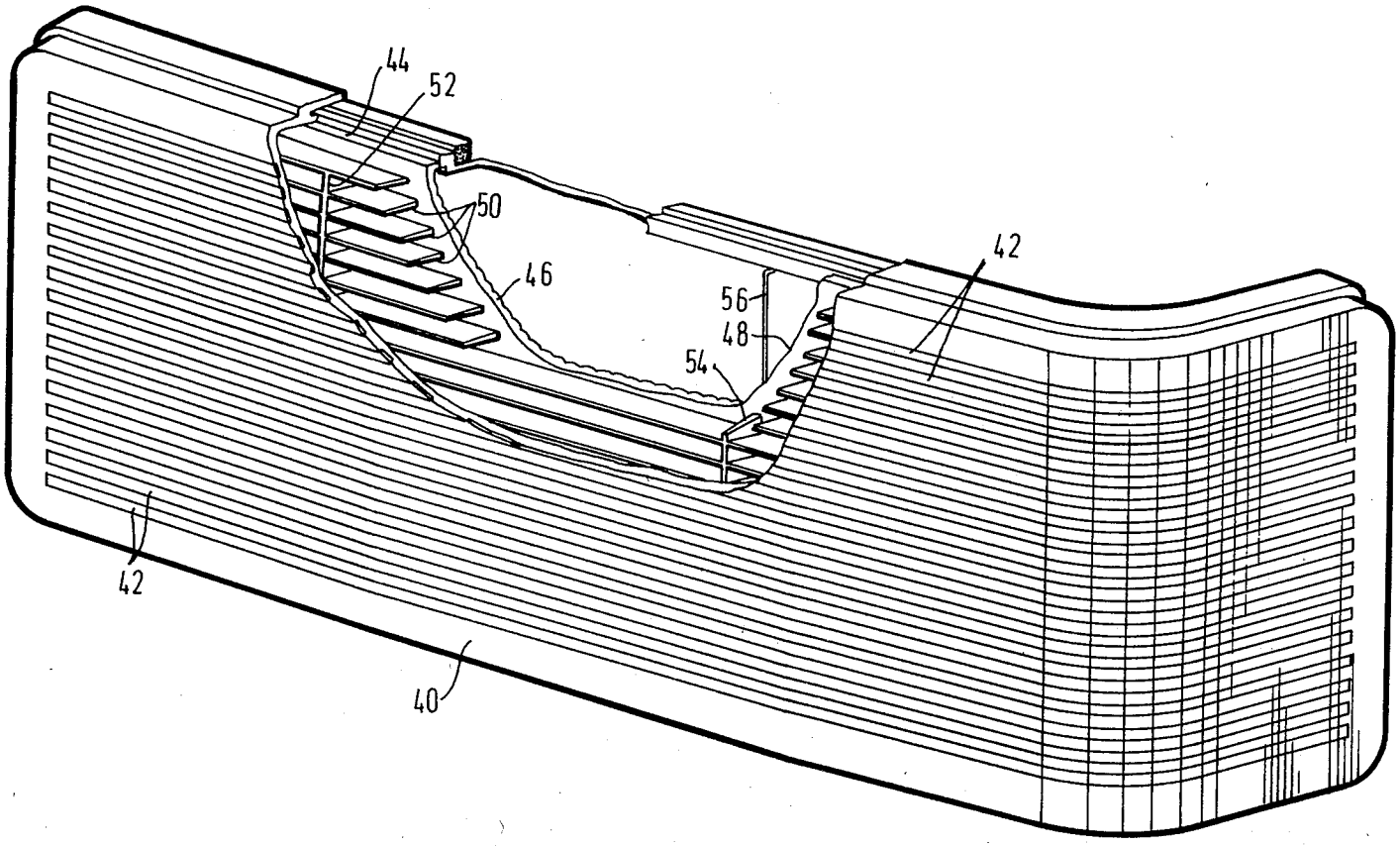

FIG. 1.
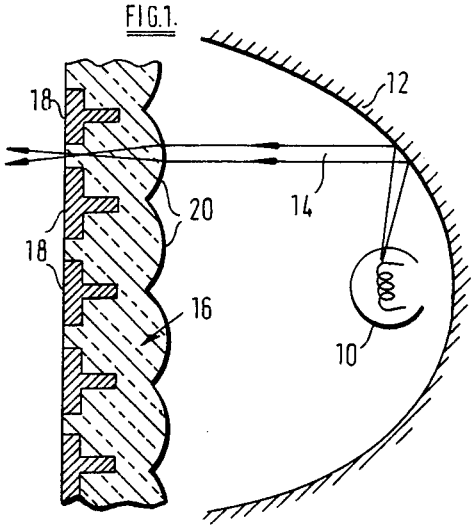
FIG. 2.
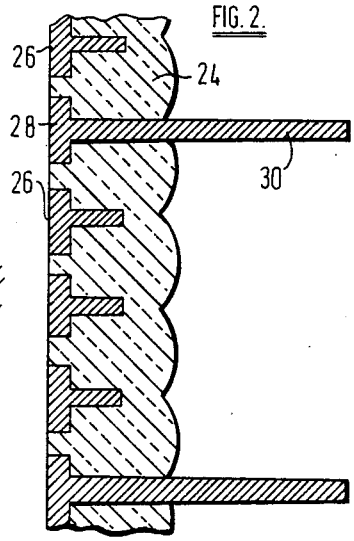
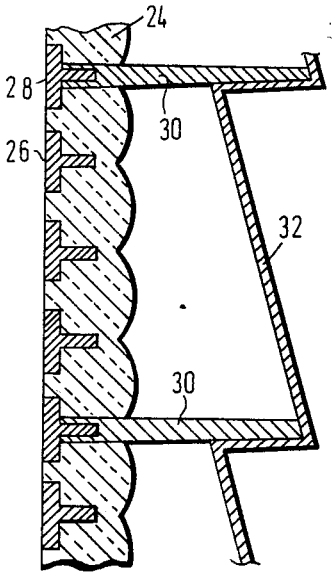
FIG. 3.
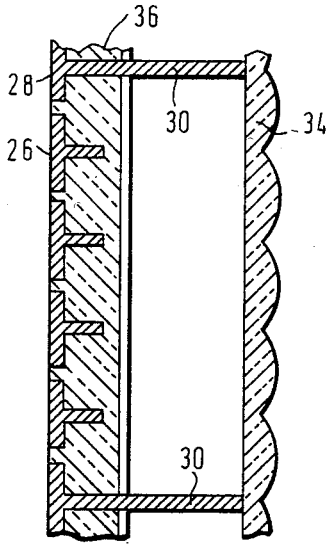
FIG. 4.

VEHICLE LAMP ASSEMBLY

This application is a continuation of application Ser. No. 408,206, filed Aug. 16, 1982, now abandoned.

This invention relates to vehicle lamp assemblies of the type in which the color of the light to be produced by the lamp cannot readily be perceived when the lamp is not illuminated. This reduces the risk that, in bright sunlight for example, the lamp assembly may appear to be illuminated, when in fact it is not.

GB Specification No. 1266129 discloses a lamp assembly of this type in which the lens consists of a light transmitting member having a plurality of parallel longitudinal strips embedded therein, each strip being of generally triangular cross section with one side of the triangle coincident with the surface of the lens remote from the light source. The present invention is concerned with the provision of a vehicle lamp assembly of this type giving an improved performance.

According to the invention, a vehicle lamp assembly comprises a light source, a light transmitting member having a plurality of parallel strips formed of a light-absorbing material and embedded in the light transmitting member with one side coincident with the surface of the light transmitting member further from the light source, lens means arranged to concentrate light from said source between adjacent strips, and baffle elements of light-absorbing material extending perpendicular to said one surface of the light transmitting member towards the light source, each baffle element being aligned with a respective one of the parallel strips.

The strips and baffles may be formed as integral T-shaped elements with each strip forming the cross bar of a T-shape and the corresponding baffle forming the stem thereof. The stems of several of the T-shaped elements may extend inwardly beyond the inner surface of the light transmitting member.

Alternatively, the baffles may be separate from the strips and disposed abutting the opposite surface of the light transmitting member from that in which the strips are embedded.

The lens means which concentrates light between the strips may comprise lens elements formed on the inside surface of the light transmitting member. Alternatively, or additionally, a separate lens member may be provided.

Several embodiments of the invention will now be described by way of example with reference to the accompanying drawings in which:

FIG. 1 is a schematic cross-sectional view of a first embodiment of the invention, FIGS. 2, 3 and 4 are fragmentary schematic cross-sectional views of second, third and fourth embodiments of the invention respectively, FIG. 5 is a perspective view of a fifth embodiment of the invention.

The lamp shown in FIG. 1 comprises a bulb 10, the light from which is collimated by a parabolic reflector 14 so that a parallel beam is incident on a light transmitting member 16 of transparent plastics material colored in accordance with the required colour of the emitted light.

The light transmitting member 16 has an array of parallel elements 18 of uniform T-shaped cross-section embedded therein with the surface of the cross-bar of the T-shape level with the outer surface of the light transmitting member 16. The inner surface of the member 16 carries cylindrical lens elements 20 which direct the collimated light from the reflector 12 between the ends of the arms of the T-shaped elements 18.

The material of which the T-shaped elements 18 are formed is generally opaque and at least the exposed surfaces thereof are either of a neutral grey color or colored to conform with adjacent body panels of the vehicle in which the lamp is to be used.

In use, when the bulb 10 is off, the predominant color of the exposed front surface of the light transmitting element 16 is that of the T-shaped elements 18. On the other hand, when the bulb 10 is illuminated, the emerging light colored by the transparent material of the light transmitting member 16 predominates and the lamp presents the required colored appearance.

In FIG. 2, the cover plate 16 is replaced by a cover plate 24, having embedded T-shaped elements 26 similar to the elements 18. In addition, however, some of the T-shaped elements, such as the elements 28, have their stems 30 projecting well beyond the inner surface of the light transmitting member 24. Any light incident on the outside of the lamp assembly which penetrates between the ends of adjacent T-shapes and is reflected by a parabolic reflector 12 will be uncollimated and the majority will be absorbed by the baffles formed by the extended stems 10. Very little will escape to the outside of the lamp.

In FIG. 3, the light transmitting member 24 of FIG. 21 is modified by the provision of a separate color filter 32 mounted on the inner ends of the stems 30. The light transmitting member 24 itself being of clear plastics material. Preferably, the color filter 32 is angled inwardly and downwardly as shown so that any incident light from outside the lamp which is reflected outwardly from either of its surfaces will be directed down towards the ground.

FIG. 4 illustrates another embodiment in which a separate lens member 34 is mounted on the inner ends of the stems 30. As illustrated, this lens member 34 has cylindrical lenses which concentrate the light between the ends of the cross-bars of the T-shaped members 28 and 30 while the inner surface of the light transmitting element 36, which replaces the element 24, is provided with cylindrical lens elements extending perpendicular to the lens elements 34 so as to contribute to the required distribution of the light emitted by the lamp assembly. A similar effect may be obtained with the embodiments of the invention illustrated in FIGS. 1 to 3 by providing circular lens elements so called "pillow optics" on the inner surface of the light transmitting member. Alternatively a separate distributer plate (not shown) may be provided outside the light transmitting member.

FIG. 5 illustrates a further embodiment of the invention in which the T-shaped members are replaced by separate strips and baffles. A light transmitting member 40, of clear, or at least colourless, light transmitting material, has a set of horizontally extending parallel strips 42 of opaque material embedded in the outer surface thereof. Disposed parallel to the member 40 are three lens elements 44, 46 and 48, each colored in accordance with the required appearance of the corresponding zone of the lamp when illuminated. For example, the lens element 44 may be clear, to serve as a reversing lamp, while the lens element 46 may be red and the lens element 48 may be amber. Each of the lens elements 44, 46 and 48 has an array of spherical lens formations on its inner surface arranged to focus collimated light on to the gaps between the strips 42.

A set of horizontally extending baffles 50, oriented parallel to the strips 42, extends between the outer element 40 and the lens elements 44, 46 and 48, each baffle 50 being aligned with a corresponding one of these strips 42. Vertically extending baffles 52 and 54 are disposed in alignment with the joints between the lenses 44 and 46 and 46 and 48 respectively, and it will be understood that, in accordance with normal practice, the chambers behind the lens elements 44, 46 and 48 are similarly divided by baffles 56 and each contains means for producing a beam of collimated light.

The baffles 50 are preferably black although the strips 42 may be of another color if desired, for example to match the vehicle body paint color.

The embodiment of the invention illustrated in FIG. 5 has the advantage that the baffles 50 are disposed in front of the transmissive colored elements. It is found that this enhances the extent to which perception of the color of the corresponding lens element is inhibited when the lamp is off.

Both of the embodiments illustrated in FIGS. 4 and 5 have the advantage over the embodiments illustrated in FIGS. 1, 2 and 3 that the lens elements are of longer focal length.

In any of the embodiments of the invention, the parabolic reflector 12 may be replaced or supplemented by a Fresnel collimator. In addition, the T-shaped elements extending across the lamp assembly may be replaced by an array of individual stud-like elements so that the light transmitting element 24, 36, has a cross-section in a plane perpendicular to that of the drawing similar to its cross-section in the plane of the drawing. As a further alternative, the cross-bar of adjacent T-shaped elements may be joined together at spaced intervals so as to form a two-dimensional array of apertures therebetween.

I claim:

1. A vehicle lamp assembly comprising a light source, a colorless light transmitting member carrying a plurality of strips formed of a light-absorbing material, baffle elements of light-absorbing material extending perpendicular to a surface of the light transmitting member towards the light source, each baffle element being aligned with a respective one of the parallel strips and being thinner than its corresponding strip in a direction parallel to said surface, lens means spaced from the light transmitting member and disposed between the light source and the baffle elements and arranged to concentrate light from the light source between adjacent baffle elements and then between adjacent strips, and a color filter spaced from the light transmitting member and disposed between the light source and the baffle elements.

2. A vehicle lamp assembly according to claim 1, wherein the color filter also comprises the lens means.

3. A vehicle lamp assembly according to claim 1, in which the baffle elements are disposed outside the color filter and lens means.

4. A vehicle lamp assembly according to claim 3, in which the baffle elements are outside the light transmitting member.

* * * * *